US008133826B2

(12) United States Patent
Klett et al.

(10) Patent No.: US 8,133,826 B2
(45) Date of Patent: Mar. 13, 2012

(54) THERMAL CONTROL STRUCTURE AND GARMENT

(75) Inventors: James W. Klett, Knoxville, TN (US); Christopher Stan Cameron, Sanford, NC (US)

(73) Assignee: UT-Battelle, LLC, Oak Ridge, TN (US)

( * ) Notice: Subject to any disclaimer, the term of this patent is extended or adjusted under 35 U.S.C. 154(b) by 783 days.

(21) Appl. No.: 11/842,407

(22) Filed: Aug. 21, 2007

(65) Prior Publication Data

US 2009/0049871 A1 Feb. 26, 2009

(51) Int. Cl.
*B32B 5/28* (2006.01)

(52) U.S. Cl. ..... 442/179; 442/104; 442/105; 442/110; 442/111; 442/182; 442/328

(58) Field of Classification Search ..... 442/30, 442/56, 315, 370, 104, 105, 110, 111, 179, 442/182, 328

See application file for complete search history.

(56) References Cited

U.S. PATENT DOCUMENTS

| | | | | |
|---|---|---|---|---|
| 1,615,294 | A * | 1/1927 | Turver | 219/212 |
| 3,172,072 | A * | 3/1965 | Willy | 338/210 |
| 5,034,594 | A * | 7/1991 | Beezhold et al. | 219/528 |
| 5,334,414 | A | 8/1994 | Edie et al. | |
| 6,229,123 | B1 * | 5/2001 | Kochman et al. | 219/549 |
| 6,303,096 | B1 * | 10/2001 | Yamamoto et al. | 423/447.2 |
| 6,373,034 | B1 * | 4/2002 | Rock et al. | 219/545 |
| 6,563,094 | B2 * | 5/2003 | Kochman et al. | 219/549 |
| 6,699,917 | B2 * | 3/2004 | Takashima | 521/174 |

* cited by examiner

*Primary Examiner* — Andrew Piziali

(74) *Attorney, Agent, or Firm* — Luedeka, Neely & Graham, P.C.

(57) ABSTRACT

A flexible thermally conductive structure. The structure generally includes a plurality of thermally conductive yarns, at least some of which are at least partially disposed adjacent to an elastomeric material. Typically, at least a portion of the plurality of thermally conductive yarns is configured as a sheet. The yarns may be constructed from graphite, metal, or similar materials. The elastomeric material may be formed from urethane or silicone foam that is at least partially collapsed, or from a similar material. A thermal management garment is provided, the garment incorporating a flexible thermally conductive structure.

6 Claims, 2 Drawing Sheets

THERMAL CONTROL STRUCTURE AND GARMENT

GOVERNMENT RIGHTS

The United States Government has rights to this invention pursuant to contract number DE-AC05-00OR22725 between the United States Department of Energy and UT-Battelle, LLC.

FIELD

This invention relates to the field of thermal management systems. More particularly, this invention relates to flexible materials and garments adaptable for heating or cooling objects or persons by thermal conduction.

BACKGROUND

Heat stress has been a problem for military personnel since armies first operated in hot environments. Greek and Roman soldiers suffered from the heat in addition to the physical burden imposed by the weight of body armor and weapons whenever they fought in the Middle East or Southwest Asia. Today's warrior faces the same problem; a combination of physical workload and lack of cooling diminish the performance of highly trained individuals. For example, during the 1967 war between Israel and Egypt, the Egyptian army sustained over 20,000 heat casualties.

The advent of chemical and biological warfare has created an increased thermal burden by requiring the use of cumbersome or encapsulating garments. Military units and First Responders attempting to conduct missions in such garments, particularly in hot environments, often find their physical endurance greatly diminished and cognitive functions impaired. Available resources are often overtaxed by demands on logistic support for such things as excess potable and cooling water, and the increased numbers of personnel that are needed to accommodate extended rest periods that are required by exhausted personnel.

Similar problems exist in the civilian sector. For example, foundry workers, chemical plant operators, and warehouse workers often find themselves limited in their capacity to perform tasks in hot climates. Mining is notorious for placing sometimes life-threatening thermal burdens on deep shaft miners (e.g., South African gold miners). On the other hand, extremely cold environments produce similar difficulties. Divers, winter sportsmen, and persons living in northern latitudes often encounter cold conditions that may induce hypothermia.

Various approaches have been adopted to reduce heat and cold stress. The simplest approach has typically been to impose well defined work/rest cycles which limit an individual's exposure time and allow for cooling-off (or warming-up) rest periods. This is often successful in minimizing fatigue and illness but severely constrains productivity and may threaten successful task performance if manpower is limited. Passive cooling systems have sometimes been employed to mitigate heat and cold stress. Passive cooling systems, such as water-soaked clothing items or ice vests are a comparatively low cost approach but provided only a limited amount of cooling. Passive heating systems such as extra layers of clothing are also comparatively low cost, but they loose their effectiveness if they become moist with perspiration, and can in fact induce hypothermia if the temperature drops.

There are many further needs for efficiently heating and cooling materials and objects such as electronic components, car seats, plants, and animals that are often inadequately addressed by present techniques. What are needed therefore are improved systems and garments for providing thermal management of persons and objects in very hot and very cold environments.

SUMMARY

The present invention provides various embodiments for a flexible sheet-like thermally conductive structure that includes a plurality of thermally conductive yarns, where at least some of the yarns are at least partially disposed adjacent to an elastomeric material. Another embodiment provides a thermal management garment that incorporates a flexible sheet-like thermally conductive structure that has a plurality of thermally conductive yarns. At least some of the yarns are at least partially disposed adjacent an elastomeric material.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration the practice of specific embodiments of a flexible thermally conductive structure and embodiments of a thermal management garment. It is to be understood that other embodiments may be utilized, and that structural changes may be made and processes may vary in other embodiments.

In one embodiment a graphite fiber woven fabric is employed to act as a passive heat spreader. While graphite fibers are good thermal conductors they are generally quite fragile. Graphite fibers are also very prickly and generally cannot be used next to a person's skin because they are very uncomfortable. To overcome these drawbacks, in various embodiments described herein the fibers are typically formed as yarns and are embedded in a collapsed foam or similar elastomeric material. The foam may be a urethane foam or a silicone foam. A low density foam may be formed adjacent or around the yarns and then worked with a doktor blade to at least partially collapse the foam. This configuration protects the graphite fibers from damage without adding a significant insulation layer. The materials form a flexible thermally conductive structure that may be fabricated into a garment, such as a shirt or a vest. As used herein, the term "flexible" refers to a material that can be manually warped without using tools and the material may be warped without breaking. The elastomeric material provides protection from skin irritation from the graphite fibers. The thermal conductivity of the graphite fibers re-distributes heat uniformly, thereby relieving distress from hot or cold spots. A heat source or heat sink that is thermally engaged with the graphite fibers may be added to provide heating or cooling of the person wearing the garment. As used herein, the term "thermally engaged with" (or variations thereof such as "in thermal engagement with") refers to an arrangement of the recited elements that permits heat transfer between two elements either by direct attachment of the elements together or by connection of the recited elements through one or more intervening elements.

Figure 1:
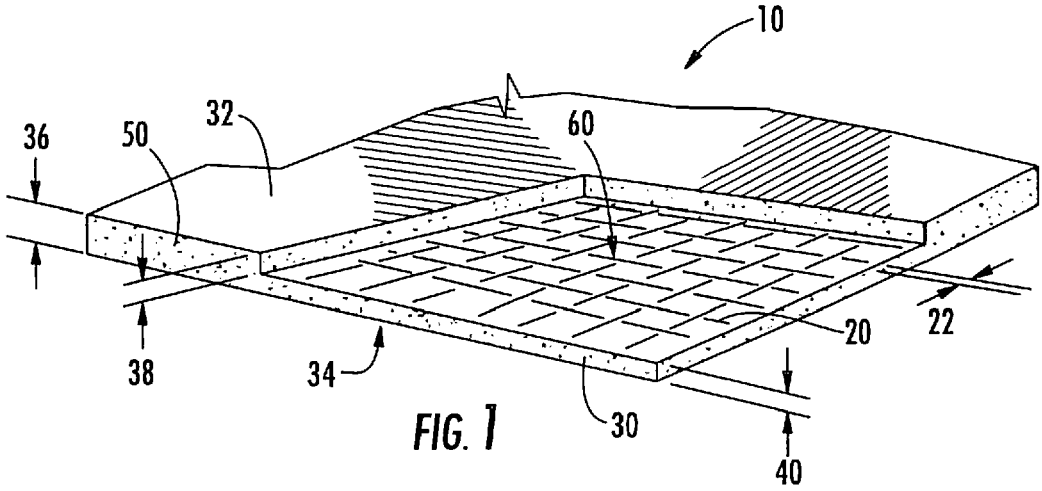
FIG. 1 is a somewhat schematic perspective view of one embodiment of a flexible sheet-like thermally conductive structure.

FIG. 1 illustrates one embodiment of flexible thermally conductive structure 10. Substantially the entire flexible thermally conductive structure 10 is configured as a sheet-like material. The term "sheet-like" is used herein in the conventional sense of a structure that is thin in comparison with its length and breadth. In some embodiments as the material may lie in a flat plane or in a curvilinear plane. In some embodiments a conductive structure may be formed into a hollow cylinder (with open ends) or formed into a hollow fully-enclosed three-dimensional geometric shape (such as a hollow cube). Hollow cylinders and hollow three-dimensional shapes are particular forms of sheets. The flexible thermally conductive structure 10 incorporates a plurality of thermally conductive yarns 20. In the embodiment of FIG. 1 the plurality of conductive yarns 20 are formed as a woven fabric, but in alternate embodiments the plurality of conductive yarns 20 may, for example, be formed as a non-woven fabric or as a layer of parallel yarns. The thermally conductive yarns 20 have a thickness 22 that that generally ranges from a few hundredths of an inch to a few tenths of an inch. In some embodiments, a thermally conductive sheet, such as a thin metal sheet may be used instead as the conductive medium.

The thermally conductive yarns 20 may be fabricated from materials that include graphite, metal, or similar thermally-conductive material. Carbon fibers are not thermally conductive, but graphite fibers are thermally conductive. Graphite fibers may be formed by heat treating a precursor fiber (such as a carbon fiber) to a state where a significant amount of graphite is formed in the fiber. Typically the graphite fibers are about 10 microns in diameter whereas the carbon fibers are about 5 microns in diameter. The fibers are typically formed in continuous lengths as 2 K tows (i.e., yarn comprising approximately 2000 fibers). The thermal conductivity of the yarn should be at least approximately 150 W/mK, and it is desirable that the thermal conductivity of the yarn be greater than about 500 W/mK.

As illustrated in FIG. 1, at least some of the plurality of thermally conductive yarns 20 are at least partially disposed adjacent to an elastomeric material 30. The elastomeric material 30 may, for example, be constructed from collapsed silicone foam, from polyurethane foam, or from polychloroprene ("neoprene"). The thermally conductive yarns 20 extend into the elastomeric material 30 between a first surface 32 and an opposing second surface 34 of the elastomeric material 30. The elastomeric material 30 has a thickness 36 that is typically a few mils to less than a tenth of an inch greater than the thickness 22 of the thermally conductive yarns 20. The thicknesses 38 and 40 of the elastomeric material 30 between the thermally conductive yarns 20 and the surface 32 and the surface 34 respectively may be adjusted to control the thermal conductivity between the thermally conductive yarns 20 and either surface (i.e., 32 or 34) of the elastomeric material 30. For example, in embodiments where the surface 32 is disposed adjacent the skin of a person and the opposing surface 34 is exposed to ambient environment, it may be desirable that the thickness 38 be minimized in order to improve thermal conductivity between the skin and the thermally conductive yarns 20, and desirable that thickness 40 be comparatively larger than thickness 38 in order to provide an insulative layer between the ambient environment and the person.

In the embodiment of FIG. 1, a thermally conductive material 50 is disposed within the elastomeric material 30 to improve thermal conductivity between the thermally conductive yarns 20 and the first surface 32 and the opposing second surface 34 of the elastomeric material 30. The conductive material 50 may, for example, include carbon particles, metal particles, thermal gels, or similar materials. In some embodiments it may be desirable to dispose the conductive material 50 only between the conductive yarns 20 and the first surface 32 of the elastomeric material 30, or desirable to dispose the conductive material 50 only between the conductive yarns 20 and the opposing second surface 34 of the elastomeric material 30.

In the embodiment of FIG. 1 the flexible thermally conductive structure 10 includes a thermal interface region 60 where at least a portion of the plurality of thermally conductive yarns 20 is exposed. In some embodiments the thickness 38 or the thickness 40 may be substantially zero in dimension, meaning that the conductive yarns 20 are exposed across the entire corresponding surface (32 or 34 respectively). As used herein the term "exposed" refers to a configuration where the recited thermally conductive yarns are not significantly thermally insulated in at least one direction. A heat source or a cold source may be placed in thermal engagement with the thermally conductive yarns 20 through the thermal interface region 60.

Figure 2:
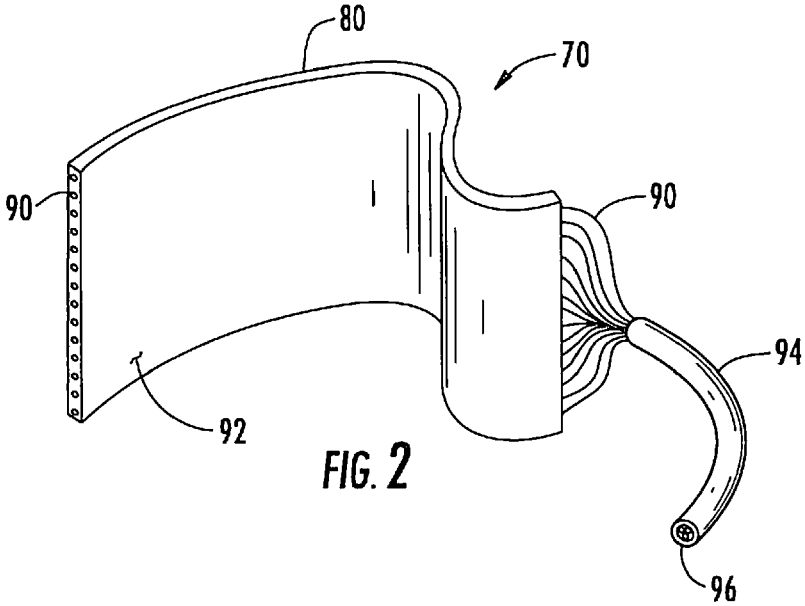
FIG. 2 is a somewhat schematic perspective view of a second embodiment of a flexible sheet-like thermally conductive structure.

FIG. 2 illustrates an alternate embodiment, a flexible thermally conductive structure 70. The flexible thermally conductive structure 70 includes a thermally conductive sheet 80. Sheet 80 incorporates a plurality of thermally conductive yarns 90 that are disposed adjacent to an elastomeric material 92. Plurality of thermally conductive yarns 90 exit the sheet 70 and are formed into a bundle 94. The flexible thermally conductive structure 70 includes a thermal interface region 96 where at least a portion of the plurality of thermally conductive yarns 90 is exposed. A heat source or a cold source may be placed in thermal engagement with the thermally conductive yarns 90 through the thermal interface region 96.

Figure 3:
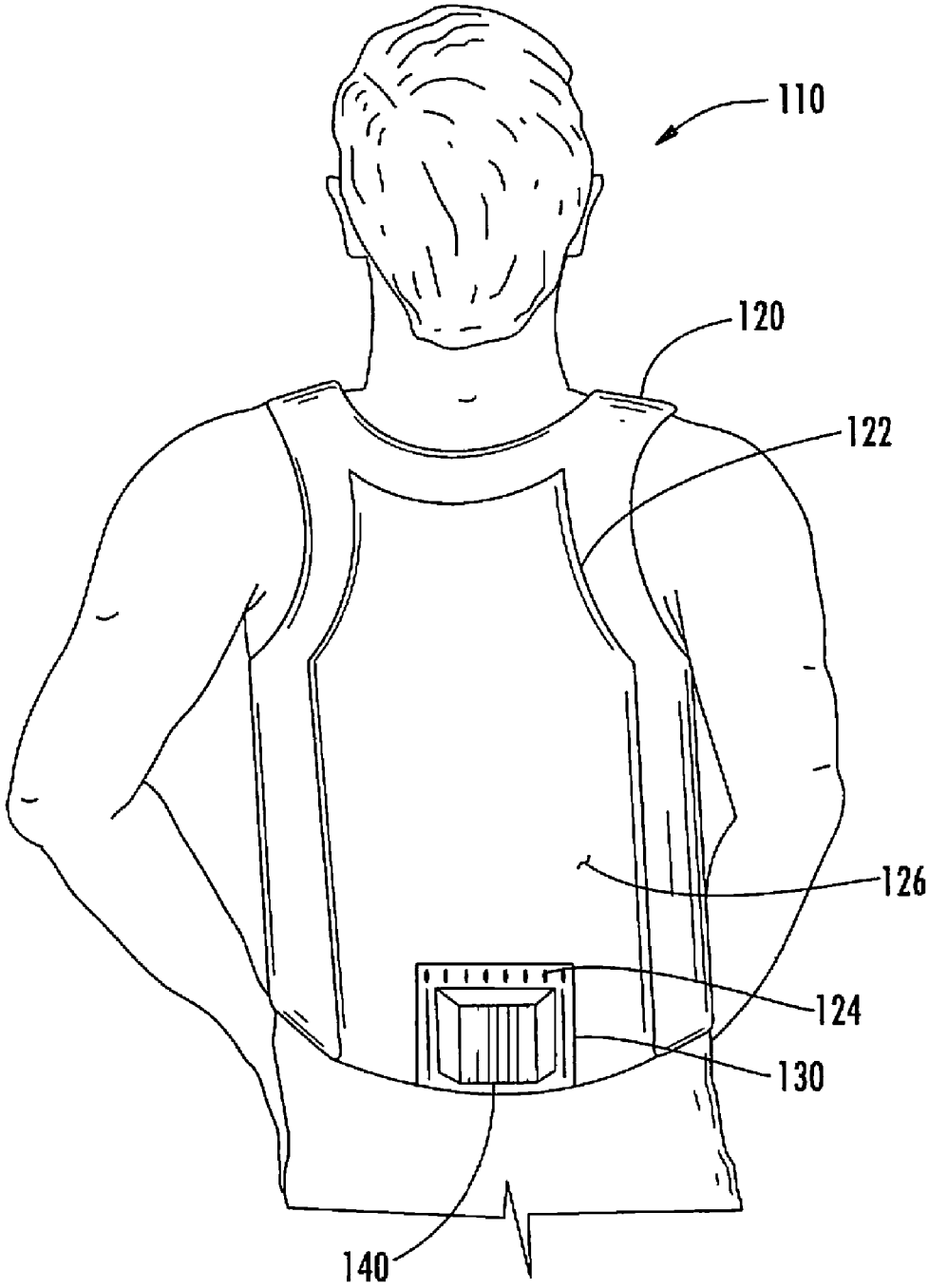
FIG. 3 is a somewhat schematic perspective view of a garment incorporating a flexible sheet-like thermally conductive system.

FIG. 3 illustrates a person 110 wearing a thermal management garment 120. The thermal management garment 120 includes a flexible thermally conductive structure 122 that has a plurality of thermally conductive yarns 124. At least some of the plurality of thermally conductive yarns 124 are at least partially disposed adjacent an elastomeric material 126. The thermally conductive structure has a thermal interface region 130 where at least a portion of the plurality of the thermally conductive yarns 124 is exposed. The thermal management garment 120 further includes a thermal moderator 140 that is thermally engaged with the at least a portion of the plurality of the thermally conductive yarns 124 at thermal interface region 130. The thermal moderator 140 may, for example, be a heat source or a cold source. The heat source may be a passive device such as a thermal battery that stores heat from the sun, or it may be an active device such as an electric heating pad. The cold source may be a passive device such as a radiator (e.g., a finned heat sink) or an active device such as a Carnot cycle refrigerator.

In summary, various embodiments of a flexible thermally conductive structure and embodiments of a thermal management garment are described herein. While emphasis has been placed on applications for heating or cooling human beings, the embodiments may also be used to heat or cool physical objects such as electronic modules, car seats, plants and animals.

The foregoing descriptions of embodiments of have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of the principles of the embodiments and their practical application and to thereby enable one of ordinary skill in the art to utilize the various embodiments and with various modifications as are suited to the particular use contemplated. All such modifications and variations are within the scope of the appended claims when interpreted in accordance with the breadth to which they are fairly, legally, and equitably entitled.

What is claimed is:

1. A flexible sheet-like thermally conductive structure comprising a plurality of thermally conductive yarns wherein at least some of the thermally conductive yarns each have a first segment of length disposed on a planar exterior surface of a first portion of an elastomeric material and wherein the first segments of length of the thermally conductive yarns are exposed to ambient environment; wherein the thermally conductive structure further comprises thermally conductive material disposed in the elastomeric material apart from the thermally conductive yarns.

2. The flexible sheet-like thermally conductive structure of claim 1 wherein the thermally conductive yarns comprise graphite yarns having a thermal conductivity greater than approximately 150 W/mK.

3. The flexible sheet-like thermally conductive structure of claim 1 wherein the thermally conductive yarns comprise graphite yarns having a thermal conductivity greater than approximately 500 W/mK.

4. A flexible sheet-like thermally conductive structure comprising a plurality of thermally conductive yarns wherein at least some of the thermally conductive yarns each have a first segment of length disposed on a planar exterior surface of a first portion of an elastomeric material and wherein the first segments of length of the thermally conductive yarns are exposed to ambient environment; wherein the thermally conductive structure further comprises carbon particles disposed in the elastomeric material apart from the thermally conductive yarns.

5. The flexible sheet-like thermally conductive structure of claim 4 wherein the thermally conductive yarns comprise graphite yarns having a thermal conductivity greater than approximately 150 W/mK.

6. The flexible sheet-like thermally conductive structure of claim 4 wherein the thermally conductive yarns comprise graphite yarns having a thermal conductivity greater than approximately 500 W/mK.

* * * * *